US005921369A

United States Patent [19]

Steele

[11] Patent Number: 5,921,369

[45] Date of Patent: Jul. 13, 1999

[54] LIMP LINER FOR CONVEYING APPARATUS

[75] Inventor: James R. Steele, Stillwater, Minn.

[73] Assignee: Dynamic Air Inc., St. Paul, Minn.

[21] Appl. No.: 08/743,490

[22] Filed: Nov. 4, 1996

Related U.S. Application Data

[51] Int. Cl.[6] ..... B65G 11/10

[52] U.S. Cl. ..... 193/25 R; 222/203

[58] Field of Search ..... 193/2 R, 4, 25 R; 220/403, 407, 410; 198/533, 550.01, 550.2; 222/203

[56] References Cited

U.S. PATENT DOCUMENTS

| | | | |
|---|---|---|---|
| 2,658,603 | 11/1953 | Fernald | 193/25 R |
| 3,099,494 | 7/1963 | Heinze | 193/25 R X |
| 3,346,917 | 10/1967 | Lennox | 222/203 |
| 3,841,530 | 10/1974 | Janninck | 222/203 X |
| 3,952,956 | 4/1976 | Steele . | |
| 4,081,110 | 3/1978 | Evans | 222/203 |
| 4,478,300 | 10/1984 | Mikami | 193/2 R X |
| 4,889,219 | 12/1989 | Key | 193/25 R |
| 5,020,651 | 6/1991 | Lockett | 193/25 R |
| 5,160,016 | 11/1992 | Moksnes | 198/533 |
| 5,215,228 | 6/1993 | Andrews et al. | 222/203 |
| 5,480,018 | 1/1996 | Sasaki | 193/2 R |

*Primary Examiner*—James R. Bidwell
*Attorney, Agent, or Firm*—Jacobson & Johnson

[57] ABSTRACT

A replaceable liner for installation in a material handling system where materials normally accumulate on an interior of a material handling apparatus, the liner characterized by being sufficiently large so that the liner is externally supported in a first normal direction when the liner is in a working condition, the liner characterized by being sufficiently strong so as to withstand without tearing a frictional sliding force produced by a material sliding along the liner even though the liner may be sufficiently weak so as not to be capable of supporting and confining the material therein; the liner having a first peripheral region for removably securing the liner in a working condition in a conveying apparatus with the liner further characterized by being sufficiently flexible so that the application of a force in a direction opposite to the normal direction liner causes the liner to flex and bend thereby dislodging any materials accumulated thereon.

11 Claims, 3 Drawing Sheets

LIMP LINER FOR CONVEYING APPARATUS

FIELD OF THE INVENTION

This invention relates generally to conveying apparatus and more specifically to a flexible lightweight liner that can be installed in a limp condition in a conveying apparatus to provide a surface area that can be periodically flexed to remove accumulated materials thereon.

BACKGROUND OF THE INVENTION

The concept of apparatus for removing materials from the interior of conveying apparatus generally involves pulsing air jets into the container to dislodge the materials from the rigid sidewall of the container. One of the drawbacks of the prior art is that unless the air jets are distributed throughout the system, the air jets may not be able to dislodge all the materials on the rigid sidewalls. The present invention provides a liner that can be pulsed to cause the liner to flex back and forth thus dislodging any material adhering to the liner through the undulation and vibrations of the flexible liner.

BRIEF DESCRIPTION OF THE PRIOR ART

U.S. Pat. No. 3,952,956 discloses a bin aerator for dislodging material that accumulates along the wall of a bin.

SUMMARY OF THE INVENTION

Briefly, the invention comprises a replaceable liner for installation in a material handling system where materials normally accumulate on the interior of a material handling apparatus. The liner is characterized by being sufficiently large so that the liner is only externally supported by a conveying apparatus in a first normal direction when the liner is in a working condition in a conveying apparatus. The liner is also characterized by being sufficiently strong so as to withstand, without tearing, a frictional sliding force produced by a material sliding along the liner even though the liner may be sufficiently weak so as not to be capable of supporting and confining the material therein it no external support was provided. The liner has a first peripheral region for removably securing the liner in a working condition in a conveying apparatus with the liner further characterized by being sufficiently flexible so that the application of a force causes the liner to flex and undulate thereby dislodging any materials accumulated thereon.

DESCRIPTION OF THE PREFERRED EMBODIMENT

Figure 1:
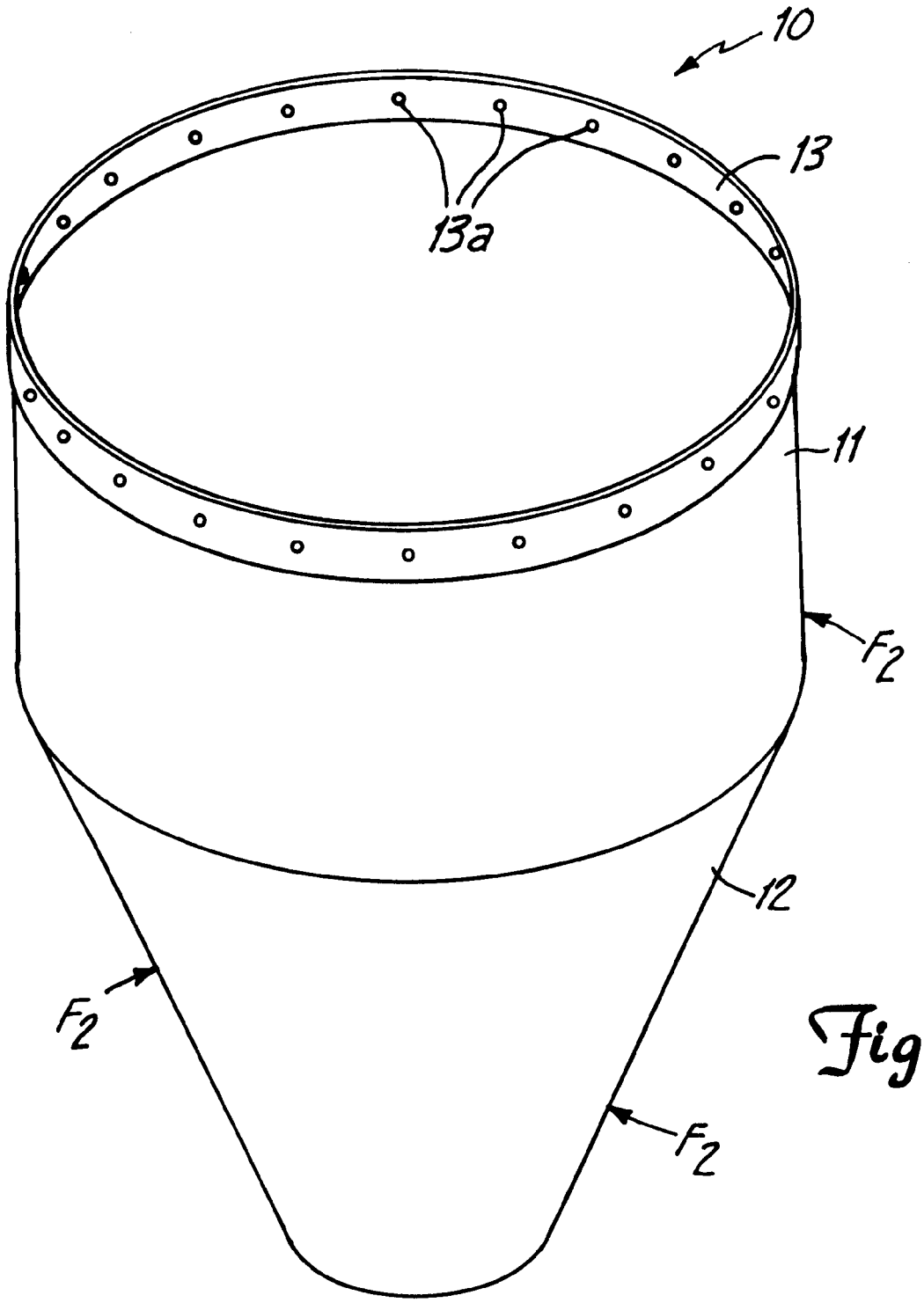
FIG. 1 shows a perspective of a free-hanging flexible liner for placing in a conveying system.

FIG. 1 shows a perspective view of the replaceable flexible liner 10 of the present invention suspended in a limp condition. In the embodiment shown, the replaceable liner 10 comprises a one-piece liner with an upper cylindrical portion 11 and a lower conical portion 12 concentrically attached to the upper cylindrical portion. The upper cylindrical portion 11 includes a metal band 13 with peripherally spaced holes 13*a* therein for securing the top peripheral region of flexible liner to the interior of a hopper or the like so that the flexible liner free-hangs from band 13. Flexible liner 10 is characterized by being sufficiently large so that when the liner 10 is placed in a container in a working condition the liner 10 remains in a limp condition as the liner is externally supported by the container in a first normal direction (indicated by arrows $F_2$). That is, the liner remains in the limp condition as the liner does not provide inward support to the material because the liner is as big or bigger than the container surfaces it rests on. The liner is further characterized by being sufficiently strong so as to withstand, without tearing, any frictional sliding force produced by materials sliding along the liner even though the liner may be sufficiently weak so as not to be capable of supporting and confining the transportable material therein. That is, if one were to fill the flexible liner 10, which hangs downward from ring 13, with conveying material, so that the liner is not in a limp condition it is quite likely that the liner material would rip as the outward gravitational forces on the liner could exceed the tear strength of the material. The liner is further characterized by being sufficiently flexible so that the application of a force in a direction opposite to the normal direction liner causes the liner to flex and undulate thereby dislodging and materials accumulated thereon. As the liner need not be strong enough to support the materials in the container, various lightweight liner materials can be used such as canvas, nylon, fiberglass, hypalon or the like. The liners can be matched to the materials being handled, for example, if an abrasive materiel is being conveyed one would use a liner with high abrasion resistance.

Figure 2:
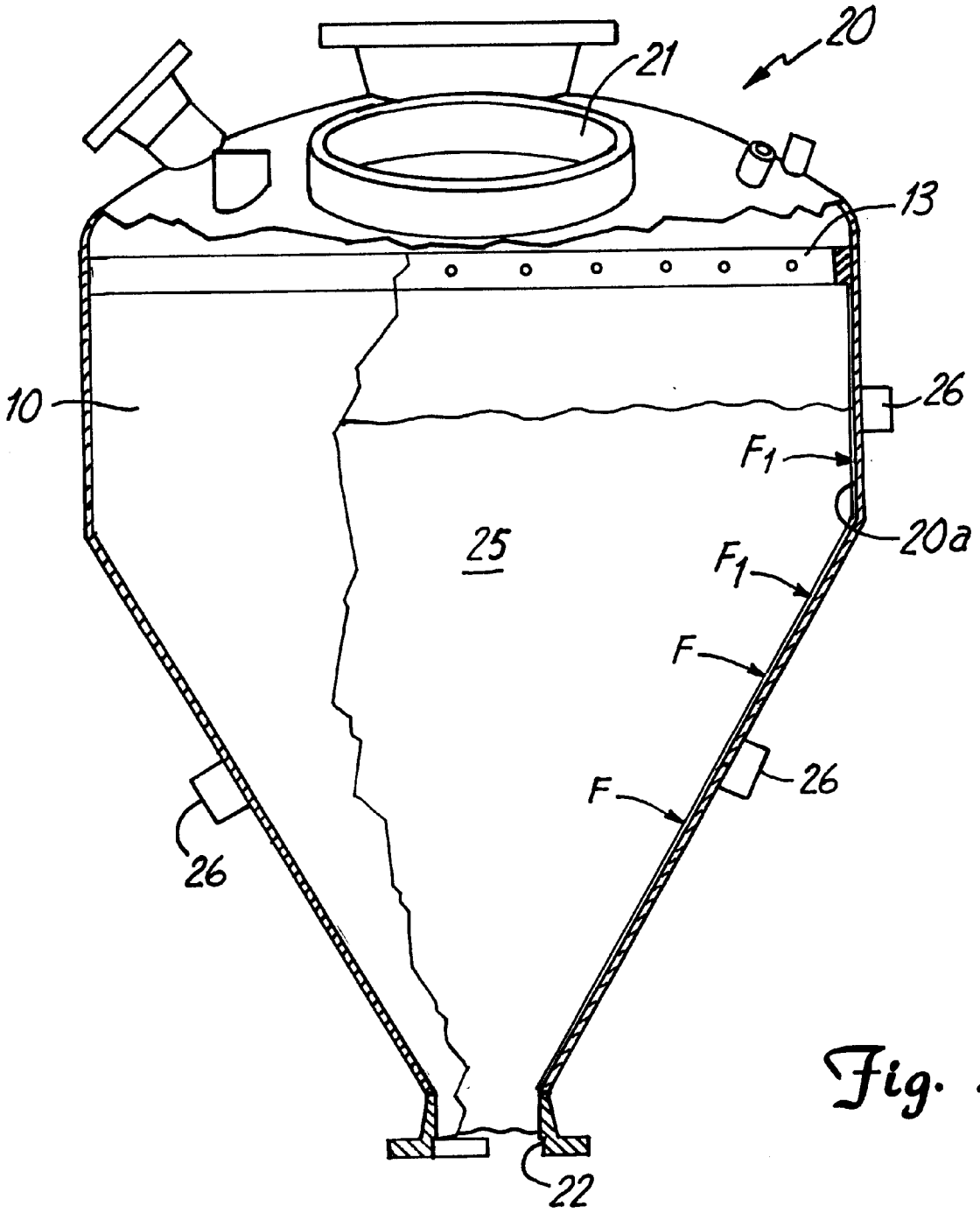
FIG. 2 shows the free-hanging flexible liner of FIG. 1 with a transportable material located therein.

FIG. 2 shows a material handling apparatus 20 partially in section with replaceable liner 10 located therein for periodically removing accumulation of materials on the sidewalls. Container 20 comprises a hopper for receiving a material to be handled with the container 20 having a top inlet 21 for receiving material 25 and a bottom outlet 22 for discharging material. The container 20 has an interior surface 20*a* which supports liner 10 thereon for directing the material 25 along the interior surface 20*a*. FIG. 2 shows the interior surface 20*a* defining a three dimensional shape within the container which is substantially identical to the shape of the free hanging liner shown in FIG. 1. The material 25 located in container 20 provides an outward force $F_1$ which holds the liner 10 against the interior surface 20*a* of container 20. The flexible free hanging liner 10 is suspended from the top of container 20 by band 13 which is secured to the top portion of container 20 by bolts or the like (not shown). Band 13 which forms a fastening member that sandwiching holds liner 10 against the interior surface of the container 20. The flexible free hanging liner 10 is sufficiently large so as to be conformable to three dimensional shape defined by inner surface 20*a* without producing outward radial stress on the liner yet liner 10 provides a covering over the interior surface 20*a*. That is, liner 10 hangs in a limp condition whether material is in the container 20 or not. In order to prevent the liner 10 from being stressed by the weight of the material 25, the liner 10 is conformable to the three-dimensional shape of container 20 by having the liner being as large or larger than the three-dimensional shape of the container as it enables the liner to be laterally supported by the container and no further stress is introduced to support the weight of materiel 25 thereon. That is, if the liner 10 were smaller than the container 20, the weight of the material 25 in the liner would produce an outward force that could tear the liner if the liner were not made of sufficiently strong materiel.

Located on the outside of container 20 is a plurality of members 26 for disturbing the conformity of the liner 10 to the container 20 to cause the liner to flex and undulate to thereby cause any material accumulated thereon to be shook free of the liner 10. Suitable members include air jets for periodically directing a pulse of air at the liner 10.

Figure 3:
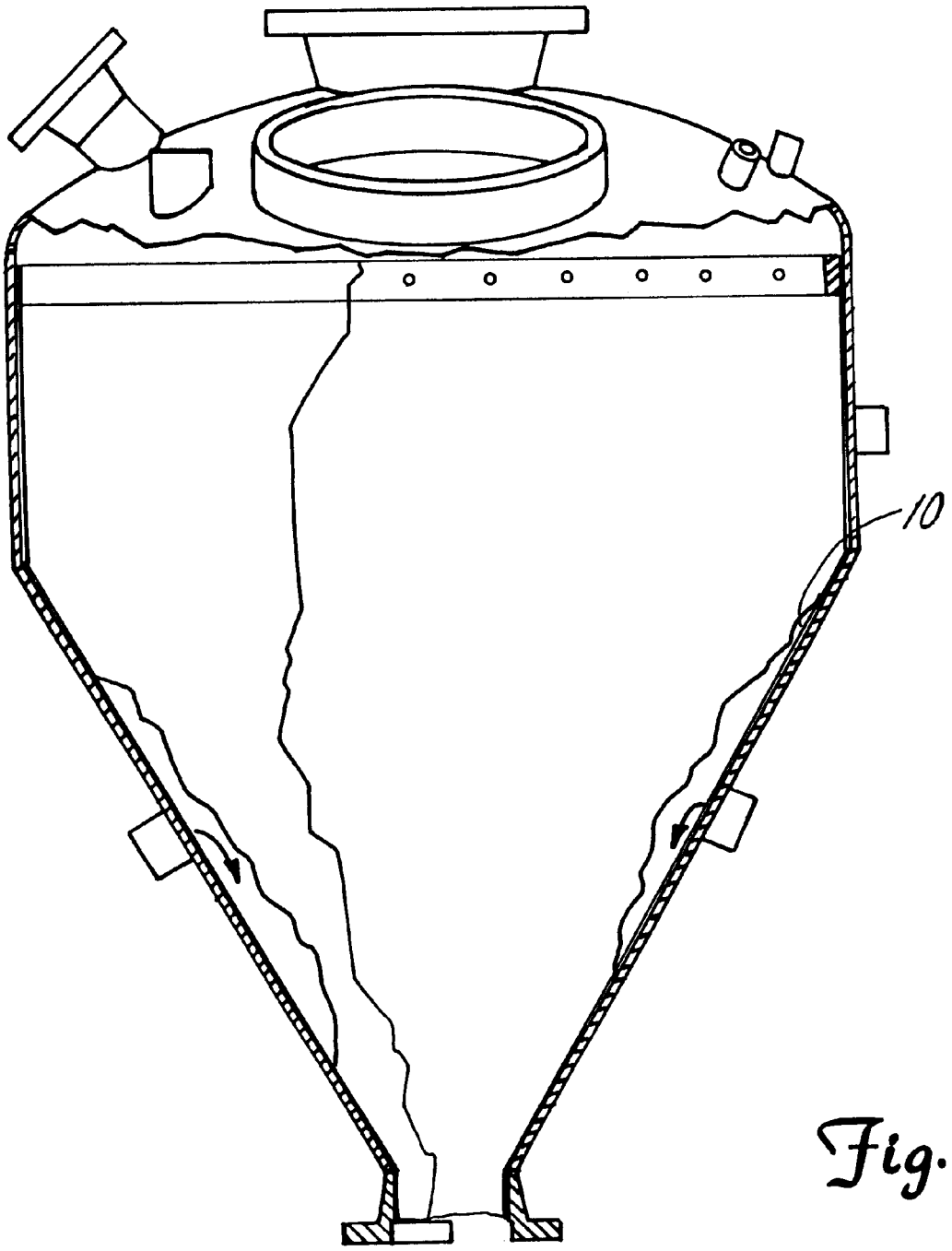
FIG. 3 shows the free-hanging flexible liner of FIG. 1 with the liners in a state of flex due to air pulsation of the liner.

FIG. 3 illustrates how the flexible liner 10 can be deflected inward by air pulses to cause the lining to flex and undulate thus causing any material located thereon to be dislodged from the liner. Thus the present invention provides a method for cleaning the sidewalls of the container as well as a method for adapting the container to carry materials that might normally clog up the system. A further feature of the present invention is that the use of the replaceable liner allows hoppers or the like with shallower angles to be used to convey materials that would normally be handled only by steeper angle hoppers. That is, a liner with less frictional resistance can be used to provide a smooth surface for materials to slide along.

I claim:

1. A material handling apparatus for periodically removing accumulation of materials on the apparatus comprising:

a container for receiving a material to be handled, said container having an inlet for receiving material and an outlet for discharging material, said conveyor having an interior surface with at least a portion of said interior surface for directing the material along the interior surface with said interior surface defining a three dimensional shape within said container, said interior surface of a first size;

a flexible free hanging liner, said flexible free hanging liner having a size equal to or larger than said interior surface so that said liner is suspended in said container in a limp condition to provide a covering over the interior surface of said container without the liner having to bear a material weight stress; and a plurality of members for disturbing the conformity of the liner to the container to cause the liner to flex and bend to thereby, cause any material accumulated thereon to shake free of the liner.

2. The material handling apparatus of claim 1 where said container comprises a transporter.

3. The material handling apparatus of claim 1 wherein said liner is made of abrasion resistant material.

4. The material handling apparatus of claim 1 wherein said interior surface includes a conical surface.

5. The material handling apparatus of claim 1 wherein said apparatus includes a rigid fastening member with said rigid fastening member sandwichingly holding said liner to the interior surface of said container.

6. The material handling apparatus of claim 1 wherein said liner comprises a fabric.

7. A removable limp liner for installation in a material handling system where materials normally accumulate on an interior of a material handling apparatus, said liner characterized by being sufficiently large so that the liner is large or larger than the material handling apparatus to enable the liner to be externally supported in a limp manner in a first normal direction when said liner is in a working condition, said liner characterized by being sufficiently strong so as to withstand without tearing a frictional sliding force produced by a material sliding along the liner even though the liner may be sufficiently weak so as not to be capable of supporting and confining the material therein; said liner having a first peripheral region for removably securing the liner in a working condition in a conveying apparatus with said liner further characterized by being sufficiently flexible so that the application of a force in a direction opposite to the normal direction of the liner causes the liner to flex and bend, thereby dislodging any materials accumulated thereon.

8. The removable liner of claim 7 including a band for sandwichingly securing said liner to said container.

9. The method of removing accumulated material from the interior of a conveying system comprising the steps of:

placing a flexible liner having a size that is large or larger than the interior surface of a conveying apparatus to enable a surface on the conveying apparatus to support the liner in a limp condition where the liner does not support the weight of the material thereon, directing material over the flexible liner with the conveying apparatus supporting both the liner and the material directed thereover;

at a later time removing any material that accumulates on the flexible liner by forcing the liner away from the interior surface with sufficient force so as to cause the liner to flex and undulate and thereby cause the material on the flexible liner to be shaken free of the liner.

10. The method of claim 9 including the step of direction pulses of air against the liner to cause the liner to flutter and flex.

11. The method of claim 10 including the step of directing the pulses of air at selected portions of the liner.

* * * * *